United States Patent [19]

Stöckl et al.

[11] Patent Number: 4,738,200

[45] Date of Patent: Apr. 19, 1988

[54] RUBBER BLANKET CYLINDER FOR A ROTARY OFFSET PRINTING MACHINE

[75] Inventors: Herbert Stöckl, Augsburg; Albert Engl, Warngau, both of Fed. Rep. of Germany

[73] Assignee: M.A.N. Roland Druckmaschinen Aktiengesellschaft, Offenbach am Main, Fed. Rep. of Germany

[21] Appl. No.: 829,418

[22] Filed: Feb. 13, 1986

[30] Foreign Application Priority Data

Mar. 14, 1985 [DE] Fed. Rep. of Germany ..... 3509046

[51] Int. Cl.[4] ..... B41F 5/00

[52] U.S. Cl. ..... 101/216; 101/142; 101/415.1

[58] Field of Search ..... 101/121, 122, 216, 375, 101/376, 377, 379, 415.1, 142

[56] References Cited

U.S. PATENT DOCUMENTS

| | | | |
|---|---|---|---|
| 3,395,638 | 8/1968 | Kirkus et al. | 101/216 |
| 3,453,955 | 7/1969 | Seel et al. | 101/216 |
| 3,453,956 | 7/1969 | Ellis et al. | 101/217 |
| 4,332,194 | 6/1982 | Gensheimer | 101/415.1 X |
| 4,341,157 | 7/1982 | Simeth | 101/415.1 X |
| 4,584,942 | 4/1986 | Sauer | 101/415.1 |

FOREIGN PATENT DOCUMENTS 101335 11/1973 German Democratic Rep. .

*Primary Examiner*—Edgar S. Burr
*Assistant Examiner*—James R. McDaniel
*Attorney, Agent, or Firm*—Frishauf, Holtz, Goodman & Woodward

[57] ABSTRACT

To prevent entirely, or at least largely, loss of contact of a pair of blanket cylinders as they roll off against each other upon passing the respective clamping grooves of the rubber blanket cylinders, the rubber blanket cylinders adjacent the edges of the clamping groove (13,14) are formed with transition zones (15,17; 16,18) which rise above a circle formed by the cylinders, in cross section. The rise (Y) is in accordance with a non-circular mathematical function, and, for a cylinder of, for example, about 20 cm diameter, can be in the order of 0.1 mm. At operating speeds of current rotary offset printing machines, the rubber blankets will hardly lose contact from each other and thus stripping formation, due to oscillations of the blanket cylinders as they roll off against each other, is effectively eliminated.

20 Claims, 6 Drawing Sheets

RUBBER BLANKET CYLINDER FOR A ROTARY OFFSET PRINTING MACHINE

The present invention relates to printing machinery and more particularly to the rubber blanket cylinder of a rotary offset printing machine, in which the blanket cylinder has a narrow, axially extending groove or slot, forming a tensioning groove or slot to receive and stretch a rubber blanket about the circumference and hold the end portions in tensioning apparatus within the groove or slot; and especially to such a rubber blanket cylinder in which the contour of the circumference of the cylinder immediately adjacent the edges of the groove or slot deviates from circular form.

BACKGROUND

Bending oscillations are caused by rolling-off of the region of the axial groove or slot on the blanket cylinder against another cylinder. All measures known heretofore to reduce, or to suppress such bending oscillations were directed to reducing the size of the surface, or circumference, with respect to circular form, in the region adjacent the edges of the tensioning grooves or slots of the cylinders. The general concept was to cause the forces which arise upon engagement of the blanket stretched on the cylinder with a counter cylinder to increase gradually. The rise in engagement force, upon build-up of the force at the impression line between the rubber blanket and a counter cylinder, thus, should have been gradual after the groove had been passed during the roll-off of the rubber cylinder against another cylinder. Fed. Rep. German Patent No. 1,139,516 and German Democratic Patent No. 101,335 illustrate such arrangements, in which the circumference of the cylinder, adjacent the groove, is depressed with respect to a theoretical circle having the axis of rotation of the cylinder as a center.

Flattening, or chording the contour of the cylinder results in loss of engagement of the rubber blanket with another cylinder against which it rolls off, for simplicity, hereinafter, referred to as the "counter" cylinder. This counter cylinder may be a plate cylinder or another rubber blanket cylinder, or another cylinder within the printing machine. In the ordinary course of rotation of such a flattened or chorded cylinder, and particularly when two similar rubber blankets roll off against each other, the rubber blankets are first in engagement and, as they roll towards the flattened or chorded surface, the rubber blankets will lose contact, in other words, the impression force, or engagement force of a rubber blanket on one of the cylinders with respect to a rubber blanket on a counter cylinder becomes zero. Within the circumferential range in which the engagement force is small, or zero, the blanket cylinder, or cylinders tend to start to oscillate about their balanced position which they tend to assume when the rubber blanket is out of contact with a counter cylinder. The speed of current modern printing machines may be in the order of between 35,000 to 45,000 revolutions per hour (not quite 600 to about 750 rpm). Depending on the speed of the machine, the engagement forces against the blanket, after there was loss of contact or loss of engagement force, will occur in the form of a pulse-like sharp impact. These impacts occur when, after rolling over the clamping grooves, the engaged adjacent cylinders again come into contact as the surfaces thereof are again circular about the axis of rotation of the respective cylinder. This pulse or shock has been termed the engagement shock. The time at which the engagement shock occurs is of substantial importance with respect to the bending dynamics of the cylinder. The highest bending dynamics occur when the engagement shock arises precisely at the lower reversal, or nodal point of a cylinder oscillation. Rotary offset printing machines having cylinder diameters of about 20 cm, with customary clamping groove widths X of between about 6 to 8 mm, result in maximum oscillatory deflections just at the most customarily used upper speed ranges of the machines in which the cylinders are installed, that is, in the range of between 40,000 to 45,000 revolutions per hour (667 to 750 rpm). The oscillations of the cylinder after the engagement shock result in striping of the printed product which may be more or less visible, and, if noticeable, is of course undesired.

THE INVENTION

It is an object to reduce the bending dynamics of the rubber blanket cylinder upon roll-off of clamping grooves against a counter cylinder, and more particularly against a similar rubber blanket cylinder, in order to reduce or entirely eliminate striping on the printed product, or, at least effectively reduce the intensity thereof.

Briefly, a blanket cylinder is formed with a transition zone adjacent the clamping groove which rises progressively radially outwardly in accordance with a non-circular mathematical function, beginning at a tangential line at which the circumference of the cylinder departs from circular shape; the extent of rise Y above a theoretical circle coincident with the major portion of the circumference of the cylinder is matched to the width X of the clamping groove such that the blankets, and hence the blanket cylinders of two engaged blanket cylinders, with blankets thereon, at the operating speed of the machine, will lose contact at most for a period of time which is substantially less than the time required by the cylinder to rotate the distance over an angle which spans the distance of the width X of the clamping groove, so that rubber blanket line contact, at the operating speed of the machine, between engaged blankets will be interrupted for a very short period of time, or not at all.

DRAWINGS

Figure 2:
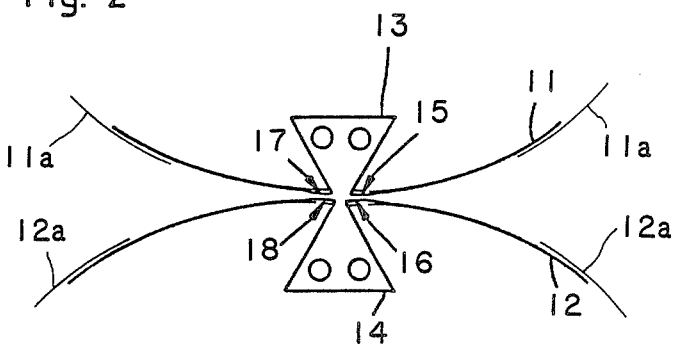
FIG. 2 illustrates the contours of the cylinders in the transition zones and adjacent the clamping grooves of the cylinders.
Figure 1:
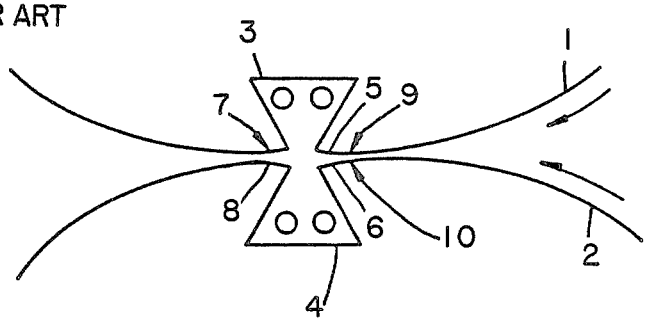
Fig. 1 PRIOR ART
FIG. 1 illustrates a prior art structure in which the contour of the cylinders in the region of clamping grooves are recessed with respect to a theoretical circle completing the cylinder.
Figure 3:
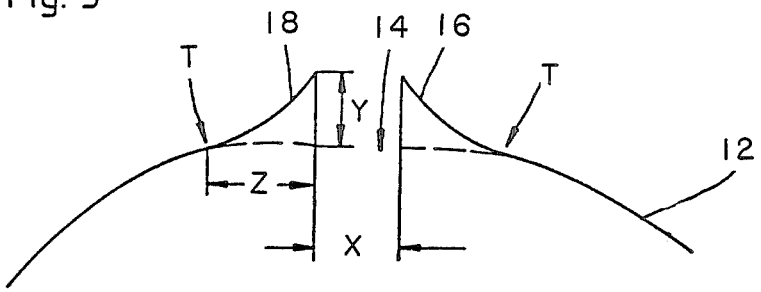
Figure 3A:
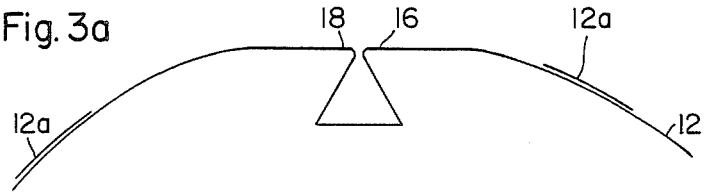
Figure 4:
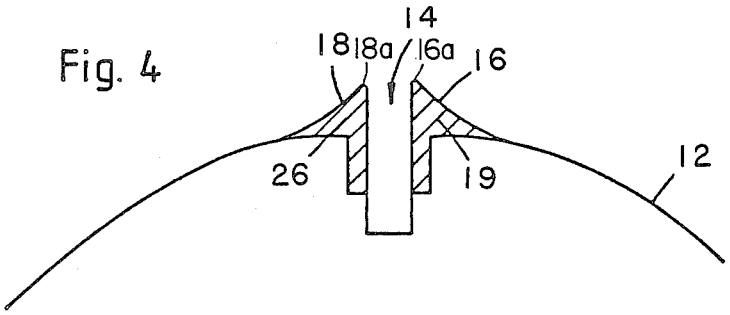
Figure 5:
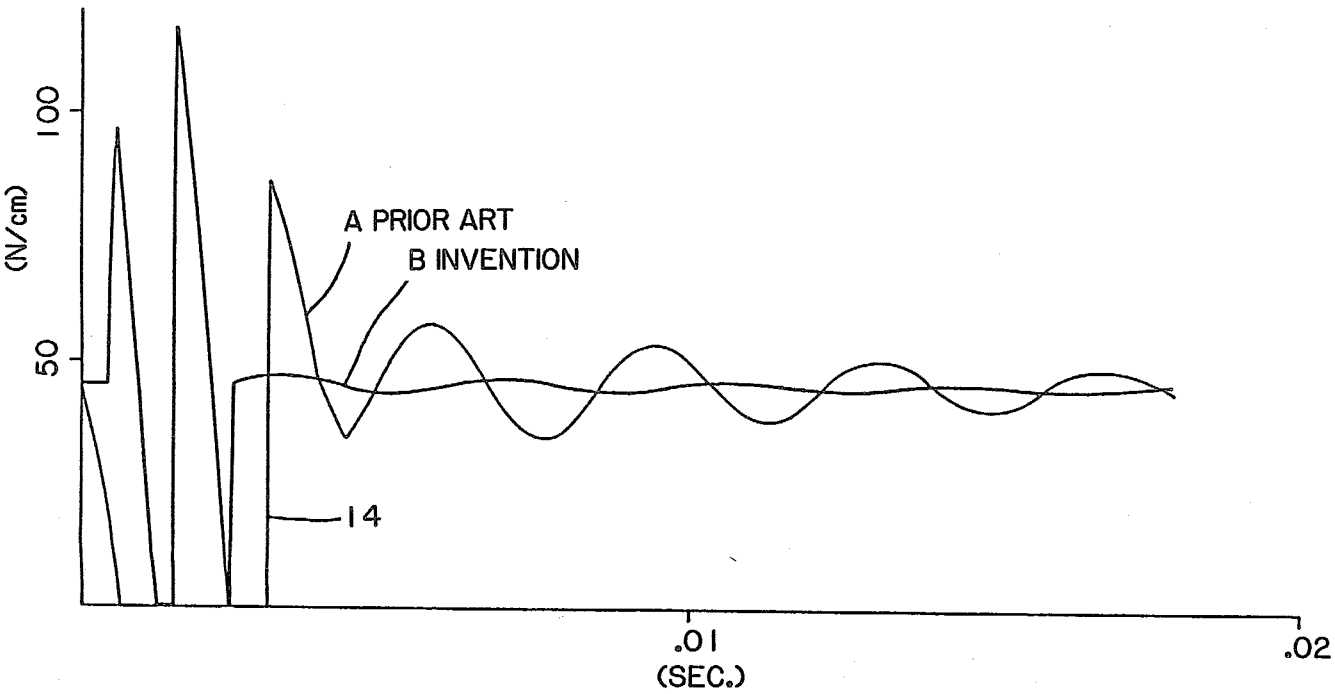
Figure 6:
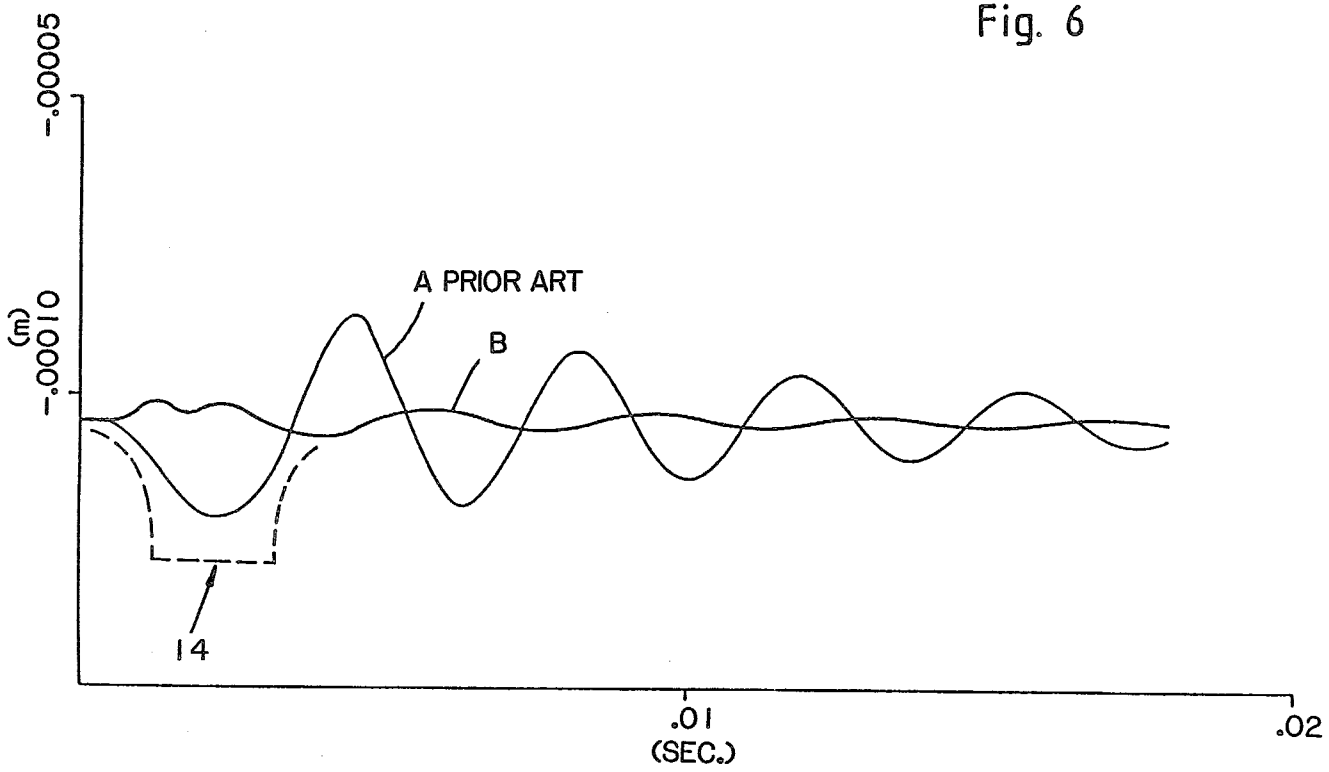
Figure 7:
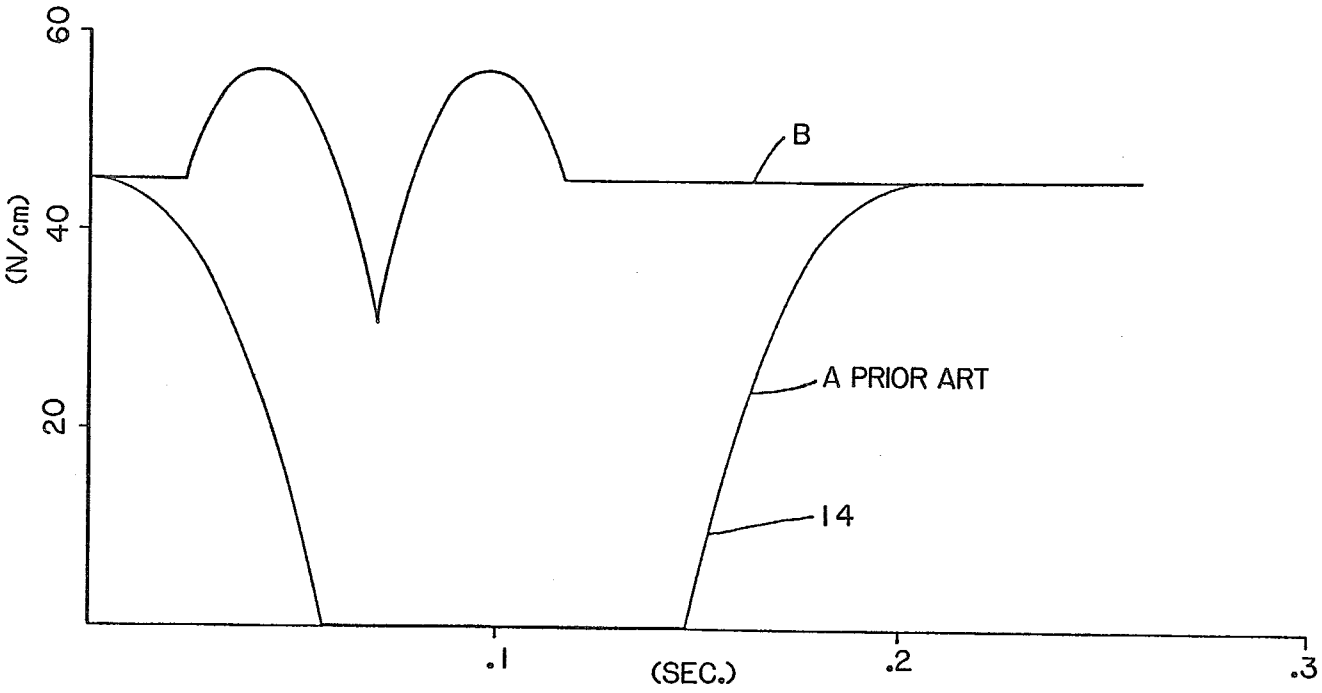
Figure 8:
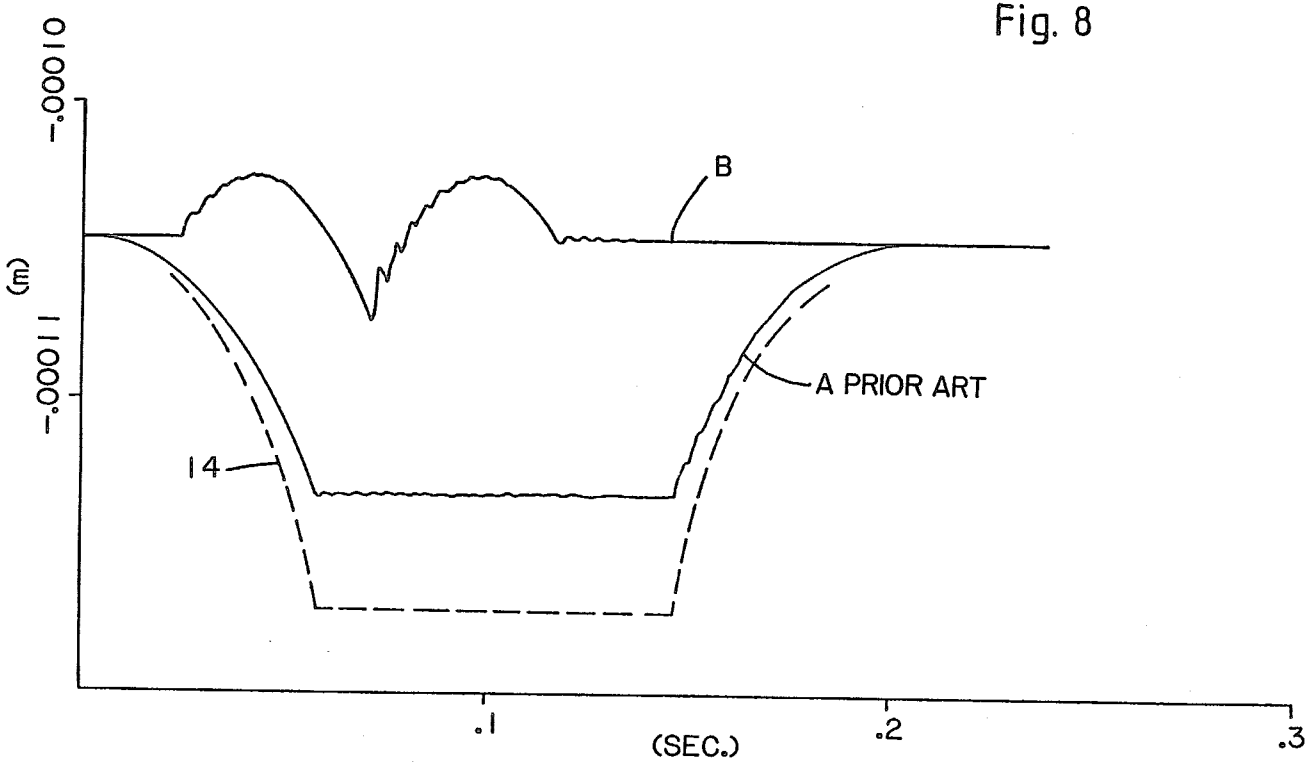

FIG. 3*a* is an end view of the cylinder of the present invention in the region of the groove, drawn to the same scale as FIGS. 1 and 2;

FIGS. 3 and 4 are highly enlarged, schematic representations,in FIG. 4 in axial section, of the rise in the cylinder adjacent the clamping groove;

FIG. 5 is a force diagram, with respect to time, of engagement forces of a cylinder blanket with respect to another cylinder blanket rolling off thereagainst;

FIG. 6 is a diagram, with respect to time, of the oscillatory deflections arising in cylinders of the prior art and in accordance with the present invention;

FIGS. 7 and 8 are exaggerated, highly enlarged diagrams of the initial portion of engagement forces and oscillatory behavior if the cylinders are operated in a creep mode, that is, upon very slow rotation, so that the diagrams represent quasi-static conditions.

DETAILED DESCRIPTION

Rubber blanket cylinders 1,2 are formed, adjacent clamping grooves 3,4—shown only schematically—with flattened transition zone surfaces 5,6 on one side and 7,8 on the other of the respective clamping grooves. FIG. 1 shows that flattening the leading and trailing transition zones 5,6,7,8 adjacent the clamping grooves 3,4, rubber blanket contact between the blankets on blanket cylinders 1,2 will be interrupted. Depending on the specific shape of the flattened transition zones 5,7 or 6,8, respectively, engagement force between the rubber blankets will tend to reach 0 and will remain zero for a comparatively long time interval. After the clamping grooves of engaged blanket cylinders have run off against each other, the blankets, above the cylinders, impact against each other. The force of engagement of the blanket cylinders will occur at the points 9,10. This force is substantially higher than the average rubber blanket engagement force as the cylinders roll off against each other. The average rubber blanket engagement force is that force which is present during normal roll-off of the blanket cylinders 1,2 against each other in regions remote from the clamping grooves.

In accordance with the present invention—see FIG. 2—the regions adjacent the clamping grooves 13,14 of two blanket cylinders 11,12, is formed with a rise above a circular cylindrical contour. Preferably, a raised surface 15,17 and 16,18 is provided at both respective sides of the clamping grooves 13,14; forming a raised surface at only one side already improves the oscillatory behavior, although forming raised surfaces at both sides of the clamping grooves results in even better performance.

The rubber blankets **11*a*,12*a* are shown only schematically, and remote from the grooves, in broken-away form, so as not to detract from the illustration of the raised surfaces 15–18, FIG. 2**.

FIG. 3 is a highly exaggerated and enlarged axial view of the increase in the profile, in which the curvature of the respective cylinder 12 is shown with a much smaller radius, for emphasis of illustration. The increase in height at the transition zones 16,18 of the cylinder 12 is clearly apparent. The increase in level is continuous, or progressive, and preferably follows a mathematical function, for example an exponential function, a parabola, a hyperbole, or a clothoid, also referred to as Euler's spiral. The increasing transition zones terminate in peaks 16', 18' at the edge of the groove, that is, at the intersection of the transition zone with the groove.

The beginning of the increase in level above circular profile of the transition or raised end portions 16,18 is at the tangential point at which the cylinder departs from circular outline, shown in FIG. 3 at the point T. FIG. 3 illustrates the raised profile in pointed form; in actual practice (see FIG. 4) a radius on the order of between about 2/10 to 3/10 mm should be maintained in order to prevent damage to the rubber blanket which, as well known and as is customary, is clamped by suitable clamping arrangements in the clamping grooves 13,14 (FIG. 2) and stretched over the circumference of the respective cylinder.

FIG. 4 is a cross sectional view, taken along an axial cross section of cylinder 12 which shows the increase in level of the transition zone on cylinder 12, obtained by placing insert strips 19,26 adjacent the edge portions of the clamping groove 14. The strips 19,26 may be secured to the cylinder by an adhesive, they can be screwed on the cylinder or otherwise attached. It is also possible, upon making the cylinder, to leave a slight raised portion and form the increase in height at the transition zone directly on the cylinder material, or to add cylinder material after the cylinder is turned to circular form, and then shape the profiled raised edge portions of the groove. FIG. **3*a* shows the transition zone to the same scale as FIGS. 1 and 2**.

It is important for proper operation of the cylinder that the raised transition zones 16,18 are so dimensioned and shaped that the rise is matched to the width of the clamping grooves 13,14. This matching, which can be obtained easily by a few experiments, must be so arranged that, upon roll-off of the grooves against each other, contact between the rubber blankets is maintained throughout or interrupted only for a much shorter period of time than that required by roll-off of the groove if non-circular transition zones were to be depressed with respect to the circumference, or be absent entirely. By so matching the raised portions 16,18 to the width X of the groove (see FIG. 3), the blanket cylinders 11,12 cannot move toward each other or roll-off over the blanket grooves 13,14 which, if they would roll into each other, would undesirably influence the dynamic oscillatory behaviour of the cylinders. In contrast to known shapes of the transition zones adjacent the clamping grooves, raising the level of the transition zone causes the blanket cylinders 11,12, just before they reach the grooves 13,14 first to be pressed away from each other due to the increased diameter at individual zones or positions of the increased height 17,18. As a consequence, the engagement force of the rubber blankets is increased with respect to average enagement force. Thereafter, as the blankets roll off over the groove, the engagement force will decrease but will not decrease to zero, as is the case in prior art structures, for any extended period of time. The deformation of the rubber blanket, of course, is subject to some inertia. It may not be possible to maintain rubber blanket engagement force continuously; if not, however, the increase in level of the transition zone will cause change in engagement force at the contact line of the rubber blankets to zero only during an extremely short period of time as the respective grooves 13,14 roll against each other.

FIGS. 5 to 8, graphically, illustrate the forces and the oscillatory behaviour of the respective cylinders.

FIG. 5, on the ordinate shows the engagement force on the rubber blanket in Newtons per centimeter (N/cm). FIG. 6 illustrates, at the ordinate, the oscillatory excursion in meters. The abscissa represents a time axis, with time indicated in seconds.

FIGS. 5 and 6 are drawn with respect to an operating speed of 30,000 revolutions per hour (500 rpm), upon roll-off or over the clamping groove 14, before and after the rubber blanket cylinders 11,12 meet each other.

In all of the illustrations, the curve A represents the conditions in a prior art structure; the curve B represents the condition in accordance with the present invention.

FIG. 5 clearly shows that when the clamping groove 14 is reached, and the profile adjacent the clamping groove is in accordance with the prior art, the engagement force applied to the rubber blanket becomes zero and remains zero over the entire width of the groove— see the thin line A. After the clamping groove 14 has been passed, the blanket cylinder force rises and then decays in form of a damped oscillation.

The heavy curved B illustrates the course of the rubber blanket force if the transition zone, adjacent the clamping groove, is made higher. Curve B clearly shows that shortly before the groove 14 is reached, the rubber blanket engagement force first increases, then decreases for a very short period of time toward zero, and then increases again substantially. After a very short time drop, the rubber blanket force then changes in accordance with a curve which has only very low oscillatory amplitudes. The substantial deflections upon changing over the groove due to the increased level of the transition zone—with respect to a circular profile—do not interfere with printing or operation, since during that time no printing is being effected anyway. The substantially improved conditions of operation of the cylinder shortly after the printing groove has been passed, however, is clearly apparent by comparing curves A and B, since the curve B shows hardly any oscillatory deflection.

The oscillatory behaviour, as a function of the deflection distance, is best seen in FIG. 6, which illustrates the deflection path of the blanket cylinder 12 as the clamping groove 14 is passed, thus illustrates the deflection distance, due to the forces shown in FIG. 5. Again, the thin line A shows the deflection which arises in accordance with prior art structures, in which the clamping groove has relieved, or depressed transition zones, the heavy line B illustrating the present invention. It can be clearly seen by comparing curves A and B that in the arrangement in accordance with the present invention, the dynamic deflection distance is substantially improved, upon passing the clamping groove or slot 14 itself, as well as immediately thereafter. Comparison with respect to the prior art structure clearly shows the essentially non-deflecting behaviour. The minor oscillations after passing the groove 14 are not longer troublesome, that is, they will not cause striations or striping on printed products.

FIGS. 7 and 8 are similar to FIGS. 5 and 6 and, again, show the rubber blanket forces (FIG. 7) and the deflection or oscillatory distances (FIG. 8) in cylinders in accordance with the present invention—curve B—an in contrast to prior art structures—curve A. FIGS. 7 and 8 represent a quasi-static condition, corresponding, for example to a speed of 720 revolutions per hour (12 rpm). The rise has an essentially constant shape.

The oscillatory paths of the rubber blanket cylinder, that is, the deflection distance, is shown in FIG. 8. Curve A for the prior art transition zones clearly shows that the cylinder deflects first in one direction, then remains essentially in the same deflected position, and, after about 0.2 seconds, again reaches it prior position. In contrast, and in accordance with the present invention, the cylinder is first lifted, then moves in the other direction, is lifted again and after already 0.12 seconds, again reaches its initial position. The entire change in position, that is the distance of movement of the cylinder with the transition zone in accordance with the present invention is only about half that of the prior art structure.

FIGS. 5 to 8 also show, in broken line form, the groove 14 itself with respect to a cylinder circumference, that is, the horizontal portion of the curve 14 illustrating the gap of the groove and the curved parts of curves 14 in the figures illustrating the transition zones. In FIGS. 5 and 7, the forces acting on the rubber blanket coincide with the deviation of the groove profile and of the transition zones from a circle with the forces to which the blanket is subjected as it folls off over the groove.

In an operative example, a rubber blanket cylinder of about 20 cm diameter and having a groove width X (FIG. 3) of between 5 to 7 mm, and a print-free zone of about 12 mm over the width of between tangential points T of deviation from circular profile, utilized a rise or tip, or peak Y of 1/10 mm. The peak or tip is provided with a radius of between about 0.2 and 0.3 mm. The distance between the tangential point T, that is, the starting point of the increased level of the transition zone, and the edge of the groove, shown as dimension Z of FIG. 3, was about 3 mm. The circumference of the 20-cm-diameter cylinder is about 628 mm, so a 5-cm- to 7-mm-wide groove takes up on the order of one percent of the circumference of the cylinder.

We claim:

1. Rotary offset printing machine adapted to operate at a printing speed of hundreds of revolutions per minute, said machine having a pair (11, 12) of blanket cylinders, each being formed with a respective narrow groove (13, 14), approximately two blanket thicknesses wide, for clamping a respective blanket (11*a*, 12*a*) thereon, said cylinders (11, 12) rotating and engaging each other during printing operations, and having a tendency to oscillate toward, and back away from, each other during a fraction of a second in which the grooves of the cylinders rotate through a line of engagement between the cylinders, thereby causing undesired striping of a printed product, comprising oscillation reduction means including an outwardly extending transition zone formed on the outer circumference of at least one (12) of said cylinders, adjacent to the groove, thereby causing the cross-sectional contour of said cylinder (12) to depart from the contour of a circle, the transition zone (15, 17; 16, 18) adjacent the groove (13, 14) rising smoothly progressively radially outwardly from the circumference of the cylinder in a non-circular mathematical function, beginning at a tangential line (T) at which the circumference of the cylinder departs from circular shape and terminating in a peak (16*a*, 18*a*) at the edge of the groove; and the extent of rise (Y) of said peak above the circle being proportional to the width (X) of the groove retaining end portions of a blanket (11*a*, 12*a*) fitted in the groove of the blanket cylinder and hence the width of the gap between said blanket end portions, said transition zone and peak, in operation of the printing machine, momentarily compressing and deforming said blankets just before passage of said groove through said line of engagement, resulting in a rebound of said blankets during said passage and reducing any time period of loss of contact between said blankets during said passage over the groove to a period of time which is, at most, substantially less than the time required by the cylinders to rotate a distance corresponding to the width (X) of the clamping groove (13, 14) at the edge thereof next to the intersection with the circumference of the respective cylinder, whereby the duration and amplitude of oscillation of said engaged cylinders (11, 12) is reduced, and striping of the printed product is correspondingly, reduced.

2. Machine according to claim 1, wherein, upon slower-than-normal rotation at about 12 revolutions per minute, said fraction of a second during which said groove passes through said line of engagement is about 0.2 second, wherein the extent of rise (Y) above the transition zone (15, 17; 16, 18) to said peak adjacent the edge of the groove (13, 14) of the blanket cylinder is so matched to the width (X) of the groove that blankets (**11*a*, 12*a***) on cylinders rolling off against each other will lose contact with each other for no more than about 0.12 second as the cylinders roll off against each other and over the groove, and the amplitude of the oscillatory excursion of each cylinder is only about half the distance of the oscillatory excursion of a cylinder without a transition zone.

3. Machine according to claim 1 wherein the transition zones (15,17; 16,18) comprises an insert strip (19,26) located at a respective side of a clamping groove (13,14) on a respective cylinder (11,12).

4. Machine according to claim 1 wherein two transition zones (15,17; 16,18) having a rise above the circle are located on both sides of the respective grooves (13,14) in the respective cylinder (11,12), and are of similar height and configuration.

5. Machine according to claim 1 wherein, for a cylinder (11, 12) having a diameter of about 20 cm, the groove and transition zone have the dimensions of:

widths of clamping groove (X) at the intersection with a circumference of the cylinder: 5 to 7 mm;

print-free zone of the respective cylinder: about 12 mm;

distance between the tangential line (T) and the edge of the respective clamping groove (13, 14): about 3 mm;

extent of rise (Y) of the circle: 1/10 mm;

configuration of peak of the transition zone (15, 17; 16, 18) at the respective groove (13, 14): rounded, with a radius between about 0.2 and 0.3 mm.

6. Machine according to claim 1 wherein the shape of the rising transition zone comprises at least one of: a parabola; a hyperbola; a clothoide; an exponential function.

7. Machine according to claim 5 wherein the shape of the rising transition zone comprises at least one of: a parabola; a hyperbola; a clothoide; an exponential function.

8. Machine according to claim 5 wherein the transition zones (15,17; 16,18) comprise insert strips (19,26) located at respective sides of a clamping groove (13, 14) on a respective cylinder (11,12).

9. Machine according to claim 5 wherein two transition zones (15,17; 16;18) having a rise above the circle are located on both sides of the respective grooves (13,14) in the respective cylinder (11,12), and are of similar height and configuration.

10. Machine according to claim 9 wherein the shape of the rising transition zone comprises at least one of: a parabola; a hyperbola; a clothoide; an exponential function.

11. Rubber blanket cylinder for a rotary offset printing machine adapted to have a rubber blanket placed thereon, said cylinder being formed with a narrow axially extending blanket clamping groove (14) having a width of approximately two blanket thicknesses, and a transition zone on the outer circumference of the cylinder adjacent to the groove, which departs from, in cross section, a circle, wherein, in accordance with the invention, said cylinder comprises means for preventing, at operating speed of the printing machine, loss of contact of a blanket of the cylinder upon rolloff against an other blanket having end portions fitted into a groove of an other cylinder in the machine, and engaged with said blanket cylinder, said contact loss prevention means including a rising portion formed in the transition zone (15, 17; 16, 18) adjacent the groove (13, 14), said portion rising progressively radially outwardly from the circumference of the cylinder in a non-circular mathematical function, beginning at a tangential line (T) at which the circumference of the cylinder departs from circular shape and terminating in a peak (**16*a*, 18*a*) at the edge of the groove; and wherein the extent of rise (Y) above the circle is so matched to the width (X) of the groove retaining end portions of a blanket (11*a*, 12*a*) fitted in the groove of the blanket cylinder, and hence to the width of the gap between said blanket end portions, that, when said cylinder is engaged with said other blanket cylinder with said other blanket thereon, and said cylinders are rolling off against each other, at operating speed of the machine, the blankets (11*a*, 12*a*) on the respective blanket cylinders (11, 12**) will not effectively lose contact as the cylinders roll off against each other and over the grooves.

12. Blanket cylinder according to claim 11 wherein the transition zones (15,17; 16,18) comprise an insert strip (19,26) located at a respective side of a clamping groove (13,14) on a respective cylinder (11,12).

13. Blanket cylinder according to claim 11 wherein two transition zones (15,17; 16,18) having a rise above the circles are located on both sides of the respective grooves (13,14) in the respective cylinder (11,12) and are of similar height and configuration.

14. Blanket cylinder according to claim 11 wherein, for a cylinder (11, 12) having a diameter of about 20 cm, the groove and transition zone having the dimensions of:

widths of clamping groove (X) at the intersection with a circumference of the cylinders: 5 to 7 mm;

print-free zone of the respective cylinder: about 12 mm; distance between the tangential line (T) and the edge of the respective clamping groove (13, 14): about 3 mm;

extent of rise (Y) above the circle: 1/10 mm;

configuration of peak of the transition zone (15, 17: 16, 18) at the respective groove (13, 14): rounded, with a radius between about 0.2 and 0.3 mm.

15. Blanket cylinder according to claim 11 wherein the shape of the rising transition zone comprises at least one of: a parabola; a hyperbola; a clothoide; and exponential function.

16. Blanket cylinder according to claim 14 wherein the shape of the rising transition zone comprises at least one of: a parabola; a hyperbola; a clothoide; an exponential function.

17. Blanket cylinder according to claim 14 wherein the transition zones (15,17; 16,18) comprise insert strips (19,26) located at respective sides of a clamping groove (13,14) on a respective cylinder (11,12).

18. Blanket cylinder according to claim 14 wherein two transition zones (15,17; 16,18) having a rise above the circle are located on both sides of the respective grooves (13,14) in the respective cylinder (11,12), and are of similar height and configuration.

19. Blanket cylinder according to claim 18 wherein the shape of the rising transition zone comprises at least one of: a parabola; a hyperbola; a clothoide; an exponential function.

20. Machine according to claim 1, wherein said narrow grooves (13, 14) in the cylinders (11, 12) each have a width in the order of a percent of the circumference of their respective cylinder.

* * * * *